US006703813B1

(12) United States Patent
Vladislav et al.

(10) Patent No.: US 6,703,813 B1
(45) Date of Patent: Mar. 9, 2004

(54) LOW DROP-OUT VOLTAGE REGULATOR

(75) Inventors: Potanin Vladislav, San Jose, CA (US); Elena Potanina, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/281,008

(22) Filed: Oct. 24, 2002

(51) Int. Cl.[7] ..... G05F 1/595
(52) U.S. Cl. ..... 323/270; 323/276; 323/303
(58) Field of Search ..... 323/268, 270, 323/273, 274, 275, 276, 279, 299, 303

(56) References Cited

U.S. PATENT DOCUMENTS 4,864,213 A * 9/1989 Kido ..... 323/222
5,036,269 A * 7/1991 Murari et al. ..... 323/266
6,373,233 B2 4/2002 Bakker et al. ..... 323/282
6,377,131 B1 4/2002 Langer ..... 332/109
6,380,721 B2 4/2002 Pattamatta et al. ..... 323/269
6,600,297 B2 * 7/2003 Takeda et al. ..... 323/266

* cited by examiner

*Primary Examiner*—Jeffrey Sterrett
(74) *Attorney, Agent, or Firm*—Brett A. Hertzberg; Merchant & Gould

(57) ABSTRACT

An LDO regulator is arranged to provide regulation with a pass device, a cascode device, a level shifter, an error amplifier, and a tracking voltage divider. The error amplifier is arranged to sense the output voltage and provide an error signal to the pass device via the level shifter. The level shifter changes the DC level of the error signal such that the pass device is isolated from damaging voltages. The cascode device is arranged to increase the impedance between the output node and the pass transistor such that the LDO regulator can sustain input voltages that exceed process limits without damage. The cascode device is biased by the tracking voltage divider. The tracking voltage divider adjusts the biasing to the cascode device such that a decreased input voltages result in lower impedance, and increased input voltages result in higher impedance.

20 Claims, 4 Drawing Sheets

LOW DROP-OUT VOLTAGE REGULATOR

FIELD OF THE INVENTION

The present invention is generally related to voltage regulators. More particularly, the present invention is related to a low drop-out voltage regulator that is tolerant to input voltages that exceed the maximum permissible voltage of the individual pass transistors.

BACKGROUND OF THE INVENTION

Voltage regulators are often used to provide a relatively constant voltage source to other electronic circuits. Some regulators are limited in their effectiveness in a particular application. For example, some regulators have a high "drop-out" voltage. A "drop-out" voltage is the minimum voltage difference between the input voltage and the output voltage that is necessary to maintain proper regulation. Large drop-out voltages result in wasted power, and raise the minimum power supply requirements for maintaining regulation.

A low drop-out regulator (hereinafter referred to as an "LDO regulator") is useful in applications where it is desired to maintain a regulated voltage that is sufficiently close to the input voltage. For example, LDO regulators are useful in battery-powered applications where the power supply voltage is exceedingly low.

A typical LDO regulator (400) is shown in FIG. 4. The LDO regulator (400) includes a PMOS transistor (MP40), a first resistor (R41), a second resistor (R42), and a voltage control block (410). The PMOS transistor (MP40) has a drain that is connected to an output terminal (VREG), a gate that is connected to node N40, and a source that is connected to an input voltage (VIN). The first resistor (R41) is series connected between the output terminal (VREG) and node N41. The second resistor (R42) is series connected between node N41 and a circuit ground (GND). The voltage control block (410) has three input terminals (VIN, VREF, SENSE) and an output terminal (PCTL). In the voltage control block (410), the first input terminal (VIN) is connected to the input voltage (VIN), the second input terminal (VREF) is connected to a reference voltage (VREF), and the third input terminal (SENSE) is connected to node N41. The output terminal (PCTL) of the voltage control block (410) is connected to node N40.

A load (ZL) is connected to the output terminal (VREG) of the LDO regulator (400). The LDO regulator (400) controls the gate of the PMOS transistor (MP40) to ensure that regulation of the output voltage (VREG) is maintained. The voltage control block (410) monitors the SENSE input terminal and controls the gate of the PMOS transistor (MP40) through the PCTL output terminal. Resistors R41 and R42 form a resistor divider that produces a signal that is related to the regulated output voltage (VREG). When the SENSE input terminal and the reference signal (VREF) are substantially the same, the LDO is properly maintaining regulation of the output voltage to the load (ZL).

SUMMARY OF THE INVENTION

Briefly stated, the present invention is related to an LDO regulator that provides regulation of an output voltage at an output node. The LDO regulator includes a pass device, a cascode device, a level shifter, an error amplifier, and a tracking voltage divider. The error amplifier is arranged to sense the output voltage and provide an error signal to the pass device via the level shifter. The level shifter changes the DC level of the error signal such that the pass device is isolated from damaging voltages. The cascode device is arranged to increase the impedance between the output node and the pass transistor such that the LDO regulator can sustain input voltages that exceed process limits without damage. The cascode device is biased by the tracking voltage divider. The tracking voltage divider adjusts the biasing to the cascode device such that a decreased input voltages result in lower impedance, and increased input voltages result in higher impedance.

A more complete appreciation of the present invention and its improvements can be obtained by reference to the accompanying drawings, which are briefly summarized below, to the following detail description of presently preferred embodiments of the invention, and to the appended claims.

DETAILED DESCRIPTION OF THE PREFERRED EMBODIMENT

Throughout the specification, and in the claims, the term "connected" means a direct electrical connection between the things that are connected, without any intermediate devices. The term "coupled" means either a direct electrical connection between the things that are connected, or an indirect connection through one or more passive or active intermediary devices. The term "circuit" means either a single component or a multiplicity of components, either active or passive, that are coupled together to provide a desired function.

The present invention is generally related to low drop-out voltage regulators (LDOs). Transistors in the LDO are manufactured according to a particular semiconductor processing technology. Example semiconductor processing technologies include field effect transistors (FETs) such as metal oxide semiconductor FETs (MOSFETs), bipolar junction transistors (BJTs), or a combination of FETs and BJTs. Transistors for each semiconductor process are evaluated according to many destructive tests to determine the limits of reliable operation. In one example, a FET is evaluated to determine a maximum gate voltage before the gate-oxide layer begins to breakdown. In another example, a FET is evaluated to determine a maximum voltage across the source and drain before the FET reaches destructive breakdown. In still another example, a BJT has a maximum collector-emitter voltage before the BJT reaches destructive breakdown.

Figure 1:
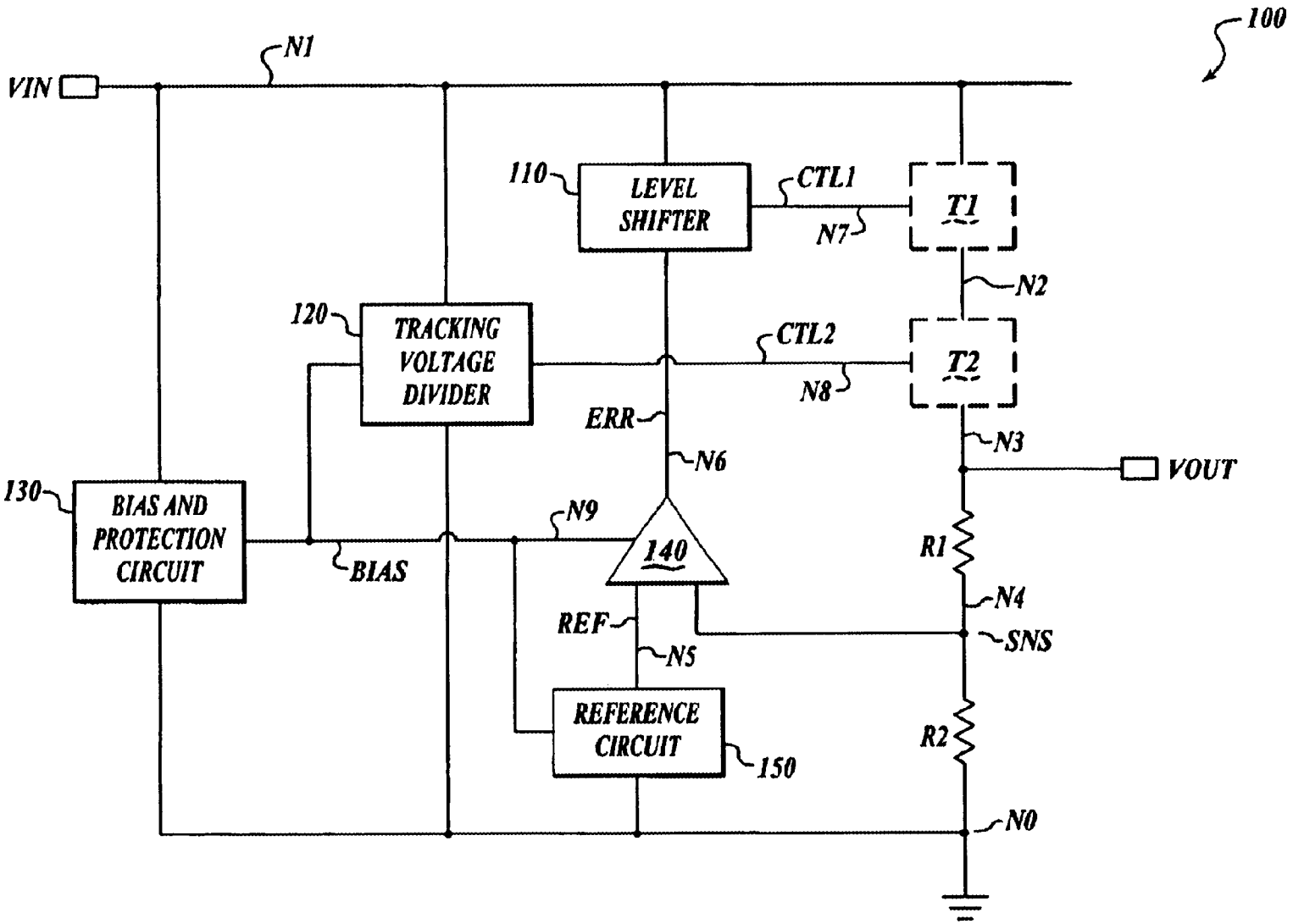
FIG. 1 is a schematic diagram of a low drop-out voltage regulator.

FIG. 1 is a schematic diagram of an exemplary low drop-out voltage regulator (100) that is arranged in accordance with the present invention. LDO 100 includes a level shifter circuit (110), a tracking voltage divider circuit (120), a bias and protection circuit (130), an error amplifier (140), a reference circuit (150), two resistors (R1, R2), and two transistors (T1, T2).

Level shifter circuit 110 is coupled to node N1, node N6, and node N7. Tracking voltage divider circuit 120 is coupled to node N0, node N1, node N8, and node N9. Bias and protection circuit 130 is coupled to node N0, node N1, and node N9. Error amplifier 140 is coupled to node N4, node N5, node N6, and node N9. Reference circuit 150 is coupled to node N0, node N5, and node N9. Resistor R1 is coupled between node N3 and node N4. Resistor R2 is coupled between node N0 and node N4. Transistor T1 is coupled to node N1, node N2, and node N7. Transistor T2 is coupled to node N2, node N3, and node N8.

Low drop-out voltage regulator 100 is arranged to provide an output voltage (VOUT) at node N3 in response to an input voltage (VIN) that is received at node N1. Transistor T1 and T2 are arranged to operate as pass transistors in the low drop-out voltage regulator (100). Transistor T1 is responsive to a first control signal (CTL1) that is received from node N7. Transistor T2 is responsive to a second control signal (CTL2) that is received from node N8. Resistors R1 and R2 are arranged to divide the output voltage (VOUT) to provide a sense signal (SNS) at node N4. Reference circuit 150 is arranged to provide a reference signal (REF) at node N5. Error amplifier 140 is arranged to provide an error signal (ERR) in response to the sense signal and the reference signal. Level shifter circuit 110 is arranged to provide the first control signal (CTL1) in response to the error signal (ERR). Tracking voltage divider circuit 120 is arranged to provide the second control signal (CTL2). Regulation is achieved when the reference signal (REF) and the sense signal (SNS) are equal. The output voltage (VOUT) is approximately determined as: VOUT≈VREF*[1+(R1/R2)].

Bias and protection circuit 130 is arranged to ensure that the tracking voltage divider 120, error amplifier 140, and reference circuit 150 are properly initialized such that the regulation process is started. The bias and protection circuit 130 is also arranged to ensure that the tracking voltage divider 120, error amplifier 140, and reference circuit 150 are protected from voltages that exceed the process limit.

One process limit for transistor T1 (e.g., the drain-source breakdown voltage) is approximately determined by the voltage drop between nodes N1 and N2. Similarly, a process limit for transistor T2 (e.g., the drain-source breakdown voltage) is approximately determined by the voltage drop between nodes N2 and N3. Transistor T2 is arranged to operate as a protection device that limits the voltage at node N2 such that transistor T1 does not exceed the process limit.

The conductivity of transistor T1 changes according to control signal CTL1. Level shifter 110 is arranged to change the DC level of the error signal (ERR) such that the control signal CTL1 does not exceed another process limit for transistor T1 (e.g., the gate-oxide breakdown voltage). The conductivity of transistor T2 changes according to control signal CTL2. Control signal CTL2 is arranged to track changes in input voltage VIN such that transistor T2 limits the voltage associated with node N2, whereby the voltage across transistor T1 is limited to prevent exceeding the process limit.

Figure 2:
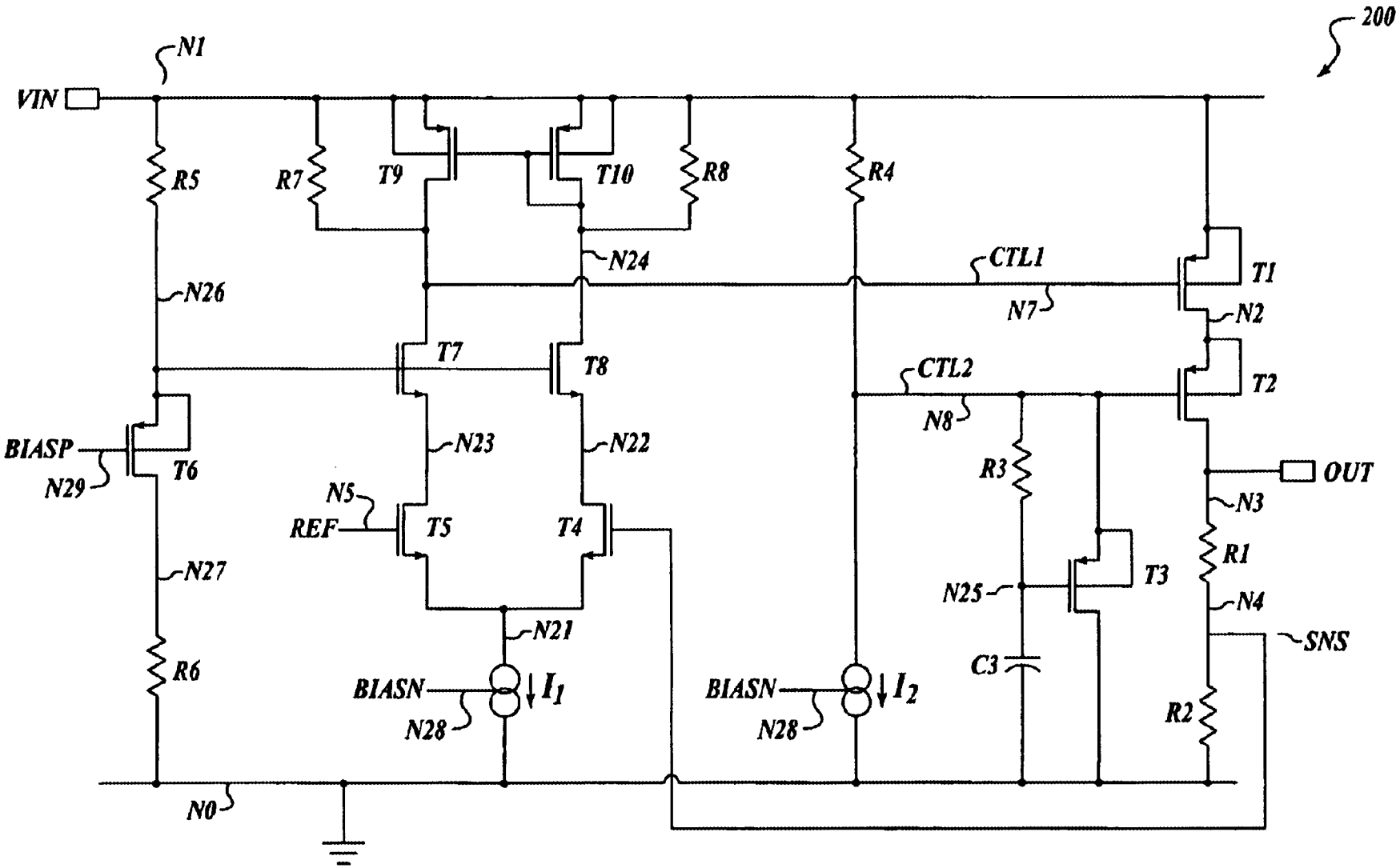
FIG. 2 is a schematic diagram of another low drop-out voltage regulator.

FIG. 2 is a schematic diagram of another exemplary low drop-out voltage regulator (200) that is arranged in accordance with the present invention. LDO 200 includes ten transistors (T1–T10), eight resistors (R1–R8), two controlled current sources (I1–I2), and a capacitor (C3). Similar components and connections from FIG. 1 are labeled identically in FIG. 2.

Transistor T1 includes a source that is coupled to node N1, a gate that is coupled to node N7, and a drain that is coupled to node N2. Transistor T2 includes a source that is coupled to node N2, a gate that is coupled to node N8, and a drain that is coupled to node N3. Resistor R1 is coupled between nodes N3 and N4. Resistor R2 is coupled between nodes N4 and N0. Transistor T3 includes a source that is coupled to node N8, a gate that is coupled to node N25, and a drain that is coupled to node N0. Resistor R3 is coupled between nodes N8 and N25. Capacitor C3 is coupled between nodes N25 and N0. Resistor R4 is coupled between nodes N1 and N8. Controlled current source I1 is coupled between nodes N8 and N0. Resistor R5 is coupled between nodes N1 and N26. Transistor T6 includes a source that is coupled to node N26, a gate that is coupled to node N28, and a drain that is coupled to node N27. Resistor R6 is coupled between nodes N27 and N0. Current source I1 is coupled between nodes N21 and N0. Transistor T4 includes a source that is coupled to node N21, a gate that is coupled to node N4, and a drain that is coupled to node N22. Transistor T5 includes a source that is coupled to node N21, a gate that is coupled to node N5, and a drain that is coupled to node N23. Transistor T7 includes a source that is coupled to node N23, a gate that is coupled to node N26, and a drain that is coupled to node N7. Transistor T8 includes a source that is coupled to node N22, a gate that is coupled to node N26, and a drain that is coupled to node N24. Resistor R7 is coupled between nodes N1 and N7. Resistor R8 is coupled between nodes N1 and N24. Transistor T9 includes a source that is coupled to node N1, a gate that is coupled to node N24, and a drain that is coupled to node N7. Transistor T10 includes a source that is coupled to node N1, and a gate and drain that are coupled to node N24.

The bias and protection circuit (130) from FIG. 1 is arranged to provide the biasing signals (BIASN, BIASP) to nodes N28 and N29 in FIG. 2. The reference circuit (150) from FIG. 1 is arranged to provide the reference signal (REF) to node N5 in FIG. 2.

The functions of error amplifier 140 and level shifter 110 are provided by transistors T4, T5, T7–T10, resistors R7–R8, and current source I1. Transistors T4–T5 and current source I1 are arranged to operate as a differential pair. The differential pair is responsive to a sense signal (SNS) at node N4, and a reference signal (REF) at node N5. Transistors T9 and T10 are arranged to operate as a current mirror circuit that is arranged to provide a reflected current from transistor T9 to node N7 in response to a current that is provided to transistor T10 at node N24. Transistors T7–T8 are arranged to operate as cascode devices that isolate the current mirror devices from the drains of transistors T4 and T5. Thus, the cascode devices act as level shifters between nodes N22 to N24, and nodes N23 to N7. Transistor T6 provides a current to resistor R5 in response to BIASP. A signal is provided to node N26 that is approximately determined by VIN–I(T6)*R5. Transistor T6, and resistors R5 and R6 are arranged to operate as a cascode bias for transistors T7–T8.

Resistor R4 and current source 12 in FIG. 2 replace tracking voltage divider circuit 120 from FIG. 1. Resistor R4 generates a voltage drop that is approximately determined by VIN–I2*R4. Bias and protection circuit 130 is arranged to provide the bias signal (BIAS) such that current source I2 provides a current that is relatively constant (e.g., as long as the transistors are non-saturated). The voltage associated with control signal CTL2 is responsive to the input voltage such that control signal CTL2 increases when VIN increases, and decreases when VIN decreases (e.g., V(CTL2)≈V(VIN)–I2*R2). When VIN drops below a limit (determined by I2*R4), the voltage associated with control signal CTL2 will collapse to the circuit ground potential (e.g., 0V). The impedance associated with transistor T2 increases when the voltage associated with control signal CTL2 increases (e.g., transistor T2 begins to turn "off"). The impedance associated with transistor T2 decreases when the voltage associated with control signal CTL2 decreases (e.g., transistor T2 begins to turn "on"). Transistor T1 is isolated from the voltage associated with the output signal (VOUT), by transistor T2, when the input signal (VIN) increases such that transistor T1 is protected from excessive voltages.

In one example, current source I2 and resistor R4 are arranged to provide a biasing limit that is associated with a drain-source breakdown voltage in a particular semiconductor process. When the input voltage (VIN) increases above the biasing limit, control signal CTL2 will increase accordingly such that the drain-source voltage across transistor T1 does not exceed the process limit. Values for the biasing limit of transistor T1 will change for different semiconductor processes such that current source I2 and resistor R4 will be need to be adjusted.

Transistor T3, resistor R3, and capacitor C3 are arranged to operate as a clamp circuit. At steady-state operation, capacitor C3 is fully charged and the voltage at nodes N8 and N25 is substantially identical. During fast transients in the input signal (VIN), the voltage associated with node N8 instantaneously changes such that transistor T3 becomes forward biased. The voltage associated with node N8 is clamped while transistor T3 is forward biased. After the transient event has subsided, capacitor C3 once again is charged to the same voltage as node N8 and transistor T3 is deactivated.

Resistors R7 and R8 are arranged to maintain transistors T1 in an OFF state (or deactivated) when the input voltage is initially applied to the circuit. The error amplifier circuit transistors (e.g., T4, T5, T7–T10) may be initially inoperable or in an unknown condition. Since node N7 is a control node for transistor T1 it is preferred that node N7 start in a known condition. While the error amplifier is inoperable, the resistors will initially define nodes N24 and N7 to be the same as the input voltage. Transistor T1 is deactivated while node N7 and node N1 have the same voltage (e.g., VGS1≈0). After the error amplifier circuit begins to operate, the error amplifier will employ feedback from the output voltage to properly define the control signal for transistor T1.

Figure 3:
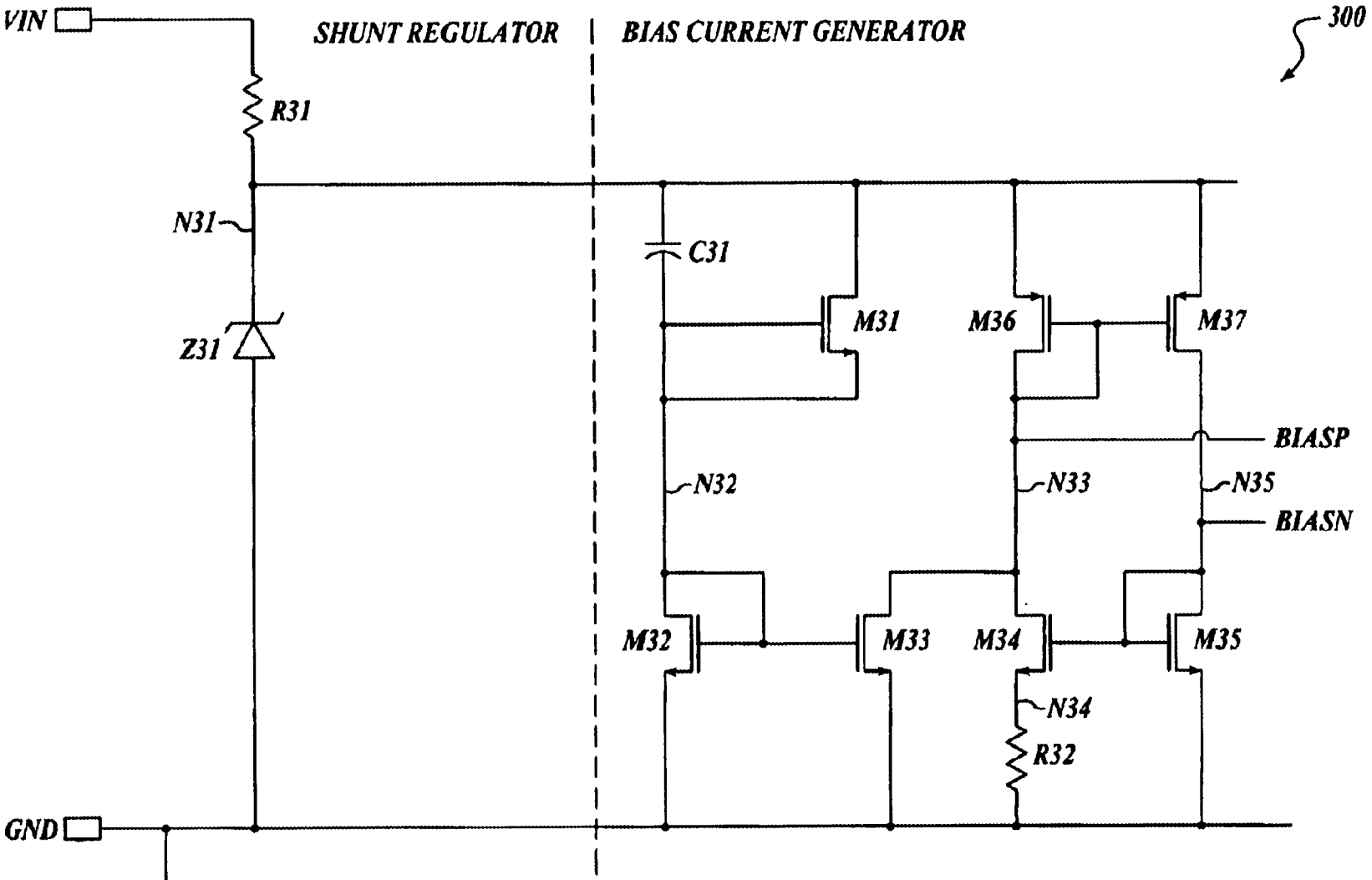
FIG. 3 is a schematic diagram of a biasing and protection circuit that is employed by the low drop-out regulator that is illustrated in FIG. 2, arranged in accordance with the present invention.
Figure 4:
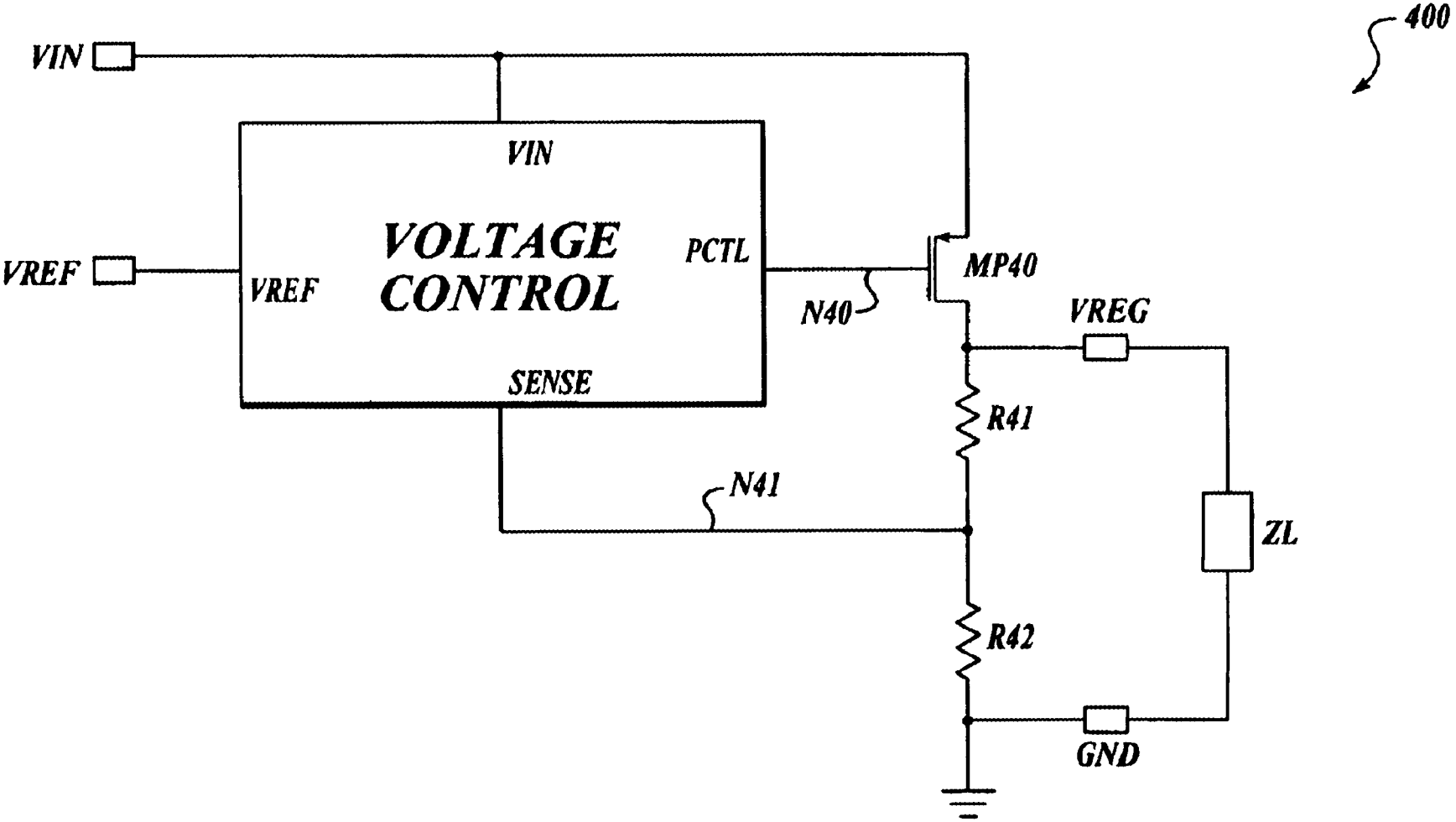
FIGURE 4 (PRIOR ART)
FIG. 4 is a schematic diagram of a conventional low drop-out voltage regulator.

FIG. 3 is a schematic diagram of a biasing and protection circuit (300) that is arranged in accordance with the present invention. The biasing and protection circuit (300) may be arranged for use by the low drop-out regulator that is illustrated in FIG. 2. The biasing and protection circuit includes a shunt regulator circuit and a bias current generator circuit. The shunt regulator circuit includes a resistor (R31), and a zener circuit (Z31). The bias current generator circuit includes a resistor (R32), a capacitor (C31), and seven transistors (M31–M37).

Resistor R31 is coupled between VIN and node N31. Zener circuit Z31 is coupled between node N31 and GND. Resistor R32 is coupled between node N34 and GND. Capacitor C31 is coupled between nodes N31 and N32. Transistor M31 includes a source and gate that are coupled to node N32, and a drain that is coupled to node N31. Transistor M32 includes a source that is coupled to GND, and a gate and drain that are coupled to node N32. Transistor M33 includes a source that is coupled to GND, a gate that is coupled to node N32, and a drain that is coupled to node N33. Transistor M34 includes a source that is coupled to node N34, a gate that is coupled to node N35, and a drain that is coupled to node N33. Transistor M35 includes a source that is coupled to GND, and a gate and drain that are coupled to node N34. Transistor M36 includes a source that is coupled to node N31, and a gate and drain that are coupled to node N33. Transistor M37 includes a source that is coupled to node N31, a gate that is coupled to node N33, and a drain that is coupled to node N35.

Resistor R31 is arranged to operate as a protection device that limits the current in the shunt regulator. The voltage at node N31 increases until zener circuit Z31 is activated. Zener circuit Z31 is arranged to clamp the voltage associated with node N31. Although zener circuit Z31 is illustrated symbolically as a zener diode, other shunt regulator circuits that are arranged to selectively clamp the voltage associated with node N31 are considered within the scope of the present invention.

Transistors M34–M37 and resistor R32 are arranged to operate as a supply-independent biasing circuit. Transistors M36 and M37 form a first current mirror that is arranged to provide a 1:1 current ratio. Transistors M34 and M35 form a second current mirror that is arranged to provide a 1:X current ratio, where X is a scaling factor between the transistors. Current is provided to resistor R32, which generates a voltage drop. The voltage drop is added to the threshold voltage of transistor M34, so that a difference between the gate to source voltages of transistors M34 and M35 is provided across resistor R32.

Transistors M31–M33 are arranged to inject a startup current into node N33 such that the biasing current generator is initialized into proper operation. Transistor M31 is arranged to provide a leakage current to node N32. Capacitor C31 is arranged to couple a fast transient signal to node N32 when VIN changes rapidly. The signals at node N32 provide currents that are reflected to transistor M33 by transistor M32, which is a diode-connected device.

In light of the above description, it is understood and appreciated that the circuits shown in FIG. 1–FIG. 3 may be redesigned such that the p-type MOS transistors are replaced with n-type MOS transistors, and vice-versa. For example transistors T1 and T2 in FIG. 2 are shown as p-type MOS devices that are referenced to a high supply (VIN) relative to ground. In another example, transistors T1 and T2 may be replaced with n-type MOS transistors that are referenced to a low supply (VIN), where the high supply corresponds to the circuit ground. Additionally, it is understood and appreciated that the design may be further arranged to operate using other field effect transistor types including, but not limited to JFET transistors, GaAsFET transistors, and the like.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A low drop-out (LDO) voltage regulator that receives an input voltage at an input node and provides a regulated output voltage at an output node, comprising:

an error amplifier circuit that is configured to provide an error signal in response to the output voltage;

a level shifter circuit that is arranged to provide a shifted error signal at a first control node in response to the error signal, wherein the shifted error signal corresponds to a DC shifted version of the error signal;

a tracking voltage divider circuit that is arranged to provide a cascode control signal at a second control node in response to the input voltage, wherein the cascode control signal is arranged to track changes in the input voltage;

a pass device that is coupled between the input node and an intermediate node, wherein the pass device is responsive to the shifted error signal such that the pass device passes current from the input node to the output node to maintain regulation at the output node; and a cascode device that is coupled between the intermediate node and the output node, wherein the conductivity of the cascode device is arranged to selectively isolate the output voltage from the intermediary node, wherein the pass device is protected from damage when the input voltage exceeds a process limit for the pass device.

2. The low drop-out (LDO) voltage regulator of claim 1, wherein the process limit corresponds to at least one of a maximum gate voltage for the pass device, and a maximum drain/source voltage for the pass device.

3. The low drop-out (LDO) voltage regulator of claim 1, further comprising: a bias and protection circuit that is configured to bias at least one of the error amplifier circuit and the tracking voltage divider circuit.

4. The low drop-out (LDO) voltage regulator of claim 3, wherein the bias and protection circuit includes a shunt regulator and a bias current generator.

5. The low drop-out (LDO) voltage regulator of claim 4, wherein the shunt regulator comprises: a first resistor that is coupled between the input node and a first node, and a zener circuit that is coupled between the first node and a circuit ground.

6. The low drop-out (LDO) voltage regulator of claim 5, wherein the bias current generator comprises:

a fifth resistor that is coupled between a fourth node and the circuit ground;

a fourth field effect transistor that includes a source that is coupled to the fourth node, a gate that is coupled to a fifth node, and a drain that is coupled to a third node;

a fifth field effect transistor that includes a source that is coupled to the circuit ground, and a gate and drain that are coupled to the fifth node;

a sixth field effect transistor that includes a source that is coupled to the first node, and a gate and drain that are coupled to the third node; and an seventh field effect transistor that includes a source that is coupled to the first node, a gate that is coupled to the third node, and a drain that is coupled to the fifth node.

7. The low drop-out (LDO) voltage regulator of claim 6, wherein the bias current generator further comprises:

a capacitor that is coupled between the first node and a second node;

a first field effect transistor that includes a source and gate that are coupled to the second node, and a drain that is coupled to the first node;

a second field effect transistor that includes a source that is coupled to the circuit ground, and a gate and drain that are coupled to the second node; and a third field effect transistor that includes a source that is coupled to the circuit ground, a gate that is coupled to the second node, and a drain that is coupled to the third node.

8. The low drop-out (LDO) voltage regulator of claim 1, further comprising a reference circuit that is configured to provide a reference signal to the error amplifier, wherein the error amplifier is configured to provide the error signal by comparing the reference voltage to the output voltage.

9. The low drop-out (LDO) voltage regulator of claim 8, wherein the reference circuit corresponds to a band-gap reference circuit.

10. The low drop-out (LDO) voltage regulator of claim 1, further comprising a resistor divider that is coupled to the output node, and configured to provide a sense signal to the error amplifier circuit in response to the output voltage.

11. The low drop-out (LDO) voltage regulator of claim 1, wherein the level shifter circuit is integrated into the error amplifier circuit.

12. The low drop-out (LDO) voltage regulator of claim 11, wherein the error amplifier circuit includes a differential pair that steers current from a current source to a current mirror through a pair of cascode devices, wherein the cascode devices are configured to operate as the level shifter circuit such that the error amplifier is protected from damage when the input voltage exceeds a third process limit for the error amplifier.

13. The low drop-out (LDO) voltage regulator of claim 12, further comprising a second current source that is coupled between a first and second resistor, wherein the first resistor is coupled to the input voltage, and the second resistor is coupled to a circuit ground, wherein the current source cooperates with the first and second resistors to provide a cascode bias signal for the pair of cascode devices in the error amplifier circuit.

14. The low drop-out (LDO) voltage regulator of claim 1, wherein the tracking voltage divider circuit includes a first resistor that is coupled between the input voltage and a current source such that the first resistor develops a voltage that corresponds to the cascode control signal.

15. The low drop-out (LDO) voltage regulator of claim 14, further comprising: a clamp circuit that includes a second resistor, a capacitor, and a transistor, wherein the second resistor is coupled between the second control node and a second intermediary node, the capacitor is coupled between the second intermediary node and a circuit ground, and wherein the second resistor and the capacitor are arranged to activate the transistor when the input signal rapidly changes such that the transistor clamps the voltage at the second control node.

16. The low drop-out (LDO) voltage regulator of claim 1, wherein the first and second pass devices correspond to one of field effect transistors, and bipolar junction transistors.

17. A low drop-out (LDO) voltage regulator that receives an input voltage at a first node and provides a regulated output voltage at a third node, comprising:

a first transistor that is coupled between the first node and a second node, wherein the first transistor is responsive to a first control signal at a seventh node;

a second transistor that is coupled between a second node and the third node, wherein the second transistor is responsive to a second control signal at an eighth node;

a fourth transistor that is coupled between a twenty-second node and a twenty-first node, wherein the fourth transistor is responsive to a sense signal at a fourth node;

a fifth transistor that is coupled between a twenty-third node and the twenty-first node, wherein the fifth transistor is responsive to a reference signal;

a seventh transistor that is coupled between the seventh node and the twenty-third node, wherein the seventh transistor is responsive to a cascode bias signal at a twenty-sixth node;

an eighth transistor that is coupled between a twenty-fourth node and the twenty-second node, wherein the eighth transistor is responsive to the cascode bias signal at the twenty-sixth node;

a ninth transistor that is coupled between the first node and the seventh node, wherein the ninth transistor is responsive to a signal from the twenty-fourth node;

a tenth transistor that is coupled between the first node and the twenty-fourth node, wherein the ninth transistor is responsive to a signal from the twenty-fourth node;

a first resistor that is coupled between the third node and the fourth node;

a second resistor that is coupled between the fourth node and a circuit ground;

a fourth resistor that is coupled between the first node and the eighth node;

a first current source that is coupled between the twenty-first node and the circuit ground; and a second current source that is coupled between the eighth node and the circuit ground.

18. The low drop-out (LDO) voltage regulator of claim 17, further comprising:

a third transistor that is coupled between the eighth node and the circuit ground, wherein the third transistor is responsive to a signal at the twenty-fifth node;

a third resistor that is coupled between the eighth node and the twenty-fifth node; and a capacitor that is coupled between the twenty-fifth node and the circuit ground.

19. The low drop-out (LDO) voltage regulator of claim 17, further comprising:

a sixth transistor that is coupled between the twenty-sixth node and a twenty-seventh node, wherein the sixth transistor is responsive to a biasing signal;

a fifth resistor that is coupled between the first node and the twenty-sixth node; and a sixth resistor that is coupled between the twenty-seventh node and the circuit ground.

20. The low drop-out (LDO) voltage regulator of claim 17, further comprising:

a seventh resistor that is coupled between the first node and the seventh node; and an eighth resistor that is coupled between the first node and the twenty-fourth node.

* * * * *

UNITED STATES PATENT AND TRADEMARK OFFICE

CERTIFICATE OF CORRECTION

PATENT NO. : 6,703,813 B1
DATED : March 9, 2004
INVENTOR(S) : Vladislav Potanin et al.

It is certified that error appears in the above-identified patent and that said Letters Patent is hereby corrected as shown below:

Title page,
Beginning "[12] Vladislav et al." should read -- Potanin et al. --
Beginning "[75] Inventors: Potanin Vladislav, San Jose , Ca (US); Elena Potanina, San Jose , CA (US)" should read -- [75] Inventors: Vladislav Potanin, San Jose, CA (US); Elena Potanina, San Jose, CA (US) --

Column 4,
Line 56, "source 12" should read -- source I2 --

Signed and Sealed this

Tenth Day of August, 2004

JON W. DUDAS
*Acting Director of the United States Patent and Trademark Office*